US007121753B2

(12) United States Patent
Rahn

(10) Patent No.: US 7,121,753 B2
(45) Date of Patent: Oct. 17, 2006

(54) PEN

(75) Inventor: Jörg Rahn, Heroldsberg (DE)

(73) Assignee: Schwan-STABILO Schwanhausser GmbH & Co. KG, Heroldsberg (DE)

( * ) Notice: Subject to any disclaimer, the term of this patent is extended or adjusted under 35 U.S.C. 154(b) by 43 days.

(21) Appl. No.: 10/487,171

(22) PCT Filed: Jun. 17, 2002

(86) PCT No.: PCT/EP02/06652

§ 371 (c)(1),
(2), (4) Date: Sep. 2, 2004

(87) PCT Pub. No.: WO03/018330

PCT Pub. Date: Mar. 6, 2003

(65) Prior Publication Data

US 2005/0002725 A1 Jan. 6, 2005

(30) Foreign Application Priority Data

Aug. 24, 2001 (DE) ..... 101 41 488

(51) Int. Cl.
*B43K 23/12* (2006.01)

(52) U.S. Cl. ..... 401/234

(58) Field of Classification Search ..... 401/99, 401/102, 234, 243, 107, 108, 250
See application file for complete search history.

(56) References Cited

U.S. PATENT DOCUMENTS 846,547 A 3/1907 Brown
1,080,197 A * 12/1913 Coffin ..... 401/102
1,505,262 A * 8/1924 Henrisch ..... 401/102
4,500,220 A 2/1985 Hashimoto

FOREIGN PATENT DOCUMENTS

| | | |
|---|---|---|
| DE | 3 89 271 | 1/1924 |
| DE | 389271 | 1/1924 |
| DE | 4 07 035 | 12/1924 |
| DE | 407035 | 12/1924 |
| DE | G 86 09 179.4 | 7/1987 |
| DE | 36 44 978 C2 | 6/1988 |
| DE | 36 40 518 C1 | 7/1988 |
| DE | G 88 08 497.3 | 8/1988 |
| DE | 42 36 449 A1 | 5/1993 |
| DE | 296 01 199 U1 | 2/1997 |

* cited by examiner

*Primary Examiner*—Huyen Le
(74) *Attorney, Agent, or Firm*—Bachman & LaPointe, P.C.

(57) ABSTRACT

A pen comprising a cartridge, a retaining sleeve for at least partially accommodating the cartridge, a locking device which can be actuated by rotation for locking the cartridge and the retaining sleeve together and a cap for protecting the cartridge, wherein the cap is displaceable axially in relation to the locking deice from a first operating position in which it is rotatable with respect to the locking device into a second operating position in which it is rotationally coupled to the locking device. The cartridge is axially displaceable with respect to the locking device, more specially by at least a distance which is equal to the spacing between the first and second operating positions of the cap.

8 Claims, 1 Drawing Sheet

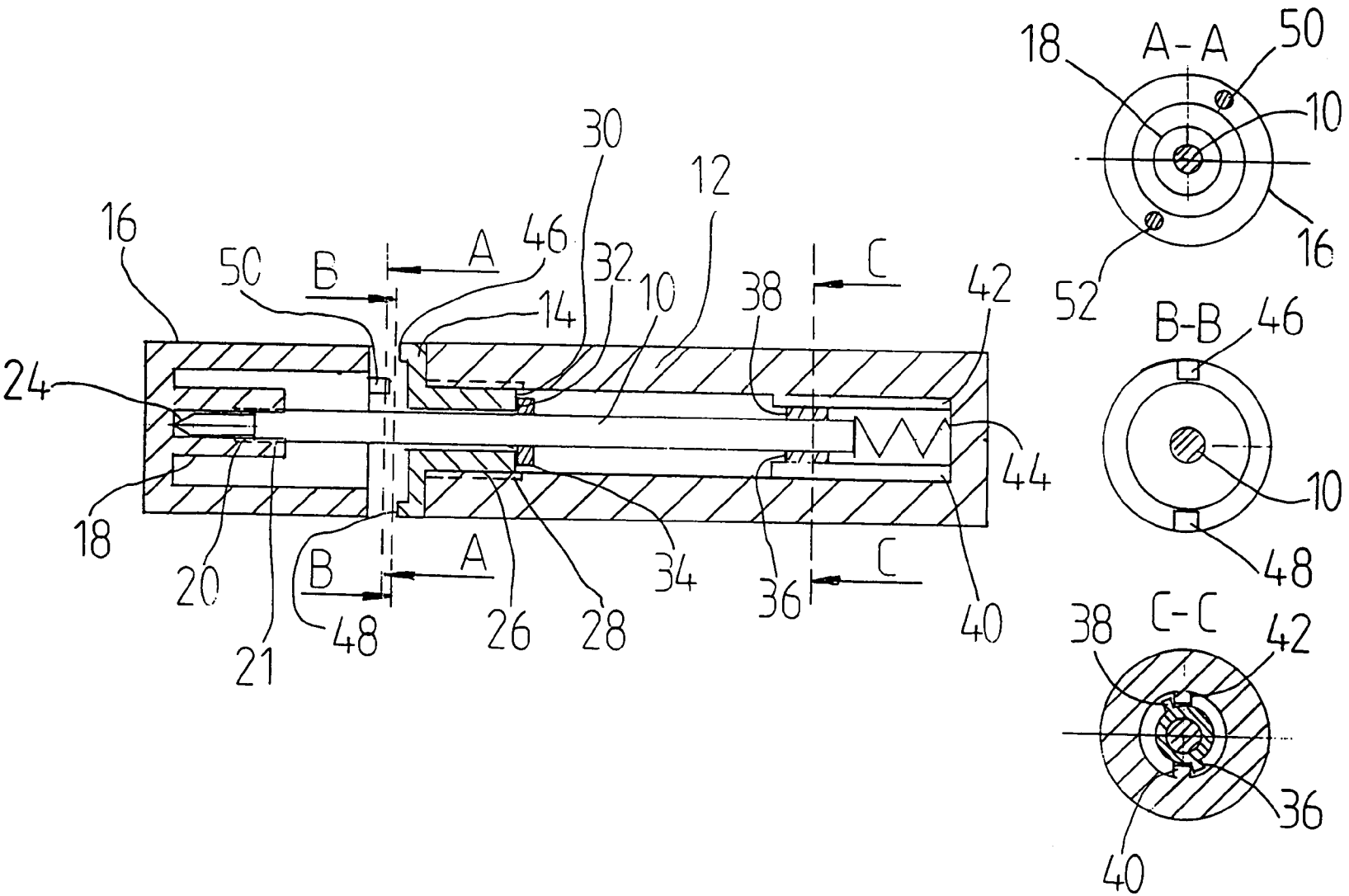
A-A
B-B
C-C
10
16
18
50
52
46
48
42
36
38
40
44
12
30
32
34
28
26
14
20
21
24
A
B
C

PEN

BACKGROUND OF THE INVENTION

The invention relates to a pen comprising a cartridge, a retaining sleeve for at least partially accommodating the cartridge, a locking device which can be actuated by rotation for locking the cartridge and the retaining sleeve together, and a cap for protecting the cartridge, wherein the cap is axially displaceable with respect to the locking device from a first operating position in which it is rotatable with respect to the locking device into a second operating position in which it is rotationally coupled to the locking device.

Pens of the kind set forth in the opening part of this specification are known, for example from DE 36 44 978 C2. In that arrangement the cap has a sealing insert which sealingly encloses a writing tip of the cartridge. The cartridge is held stationarily with respect to the locking device. When the cap is moved into the second operating position the sealing insert is displaced along the writing tip.

The above-outlined structure has been found to be unsatisfactory, in particular in regard to lack of sealing integrity.

DE 36 40 518 C1 discloses a comparable pen. In that case however the cap is not displaced approximately axially but is compressed radially for moving it from its first operating position into its second operating position. That way of handling it is found to be impractical. In addition there is the disadvantage with this structure that the cap must be of a comparatively large diameter so that it can be radially compressed.

The object of the present invention is to overcome the above disadvantages and in particular to provide a pen in which the cap reliably seals off the writing tip of the cartridge but which is nonetheless simple to handle and which takes up as little space as possible.

SUMMARY OF THE INVENTION

In accordance with the invention, in a pen of the kind set forth in the opening part of this specification, that object is attained in that the cartridge is axially displaceable with respect to the locking device, more specifically by at least a distance which is equal to the spacing between the first and the second operating positions of the cap.

In other words the pen is of such a configuration that, upon axial displacement for moving it from the first operating position into the second operating position, the cap does not have to be displaced with respect to the cartridge so that adverse effects on sealing integrity, which are attributed to such displacement, are excluded. In addition, there is no need for pressing the cap radially inward, so that handling is a simple matter. Finally, there is no need to provide space into which the outer cap wall can be radially pressed, so that the diameter of the cap can be minimised.

It will be appreciated that it can be provided that the cartridge is to be manually reset after the cap has been reset from the second operating position back into the first operating position. In comparison therewith however what is preferred in accordance with the invention is automatic return by an elastic return device which biases the cartridge in a direction axially out of the retaining sleeve.

In accordance with the invention the return device preferably involves a coil spring. That affords a particularly simple design configuration.

All possible ways of mounting the cap on the cartridge, in particular fitting it to the writing tip of the cartridge, can be envisaged in accordance with the invention. Preferably in accordance with the invention however the cap is adapted to be screwed to the cartridge. That achieves a particularly high level of sealing effect.

In a transposed sense, the same applies in regard to the connection of the locking device to the retaining sleeve. In this case also the most widely varying design configurations can be envisaged in accordance with the invention. In a particularly preferred feature however the locking device is adapted to be screwed to the retaining sleeve. More specifically such a screw connection is on the one hand particularly reliable while on the other hand it is particularly easy to handle.

In accordance with a particularly preferred embodiment of the invention the locking device has an abutment which is remote from a working end of the cartridge and with which there co-operates an abutment on the cartridge, which is towards the working end. In this configuration the cartridge is reliably locked within the retaining sleeve.

It is particularly preferred in accordance with the invention for a component of a coupling device which serves for rotational coupling of the cap to the locking element to be disposed on the end of the cap which in the fitted condition is towards the locking device.

By virtue of that arrangement, there is no need to provide any space for the coupling device, which would increase the diameter, so that the diameter of the cap is reduced for example in comparison with the structure disclosed in DE 36 40 518 C1.

Further preferably in accordance with the invention at least one projection on the cap serves for rotational coupling of the cap to the locking device. Preferably in accordance with the invention, additionally or alternatively, at least one projection on the locking device serves for rotationally coupling the cap to the locking device. That design configuration guarantees particularly reliable rotational coupling.

Particularly when the cap can be screwed to the cartridge it is particularly preferably provided that the cartridge is rotatable with respect to the locking device and is rotationally coupled to the retaining sleeve. That prevents the cartridge from undesirably also being rotated, when the cap is screwed on or unscrewed.

BRIEF DESCRIPTION OF THE DRAWINGS

The invention is described in greater detail hereinafter with further features thereof by means of a preferred embodiment with reference to the accompanying drawing in which:

The single FIGURE shows a longitudinal section and three cross-sections of a particularly preferred embodiment of the pen according to the invention.

DETAILED DESCRIPTION

The drawing shows a pen which has a cartridge 10, a retaining sleeve 12, a locking device 14 and a cap 16.

The cap 16 has a sealing insert 18 with a female screwthread 10. With the female screwthread 20, the cap 16 is screwed on to a corresponding male screwthread 22 in the region of the writing tip 24 of the cartridge 10. That connection of the cap 16 to the cartridge 10 ensures a high level of sealing integrity.

For locking the cartridge 10 within the retaining sleeve 12, the locking device 14 is screwed by means of a male screwthread 26 into a corresponding female screwthread 28 on the retaining sleeve 12. In that situation it bears with its side 30 remote from the writing tip 24 against a side 32, which is towards the writing tip 24, of a protrusion 34 on the cartridge 10.

The cartridge 10 is held rotatably with respect to the locking device 14. Provided at its end portion, that is remote from the writing tip 24, are protrusions 36, 38 which, upon a rotary movement of the cartridge 10, butt against protrusions 40, 42 within the retaining sleeve 12 and thus limit the rotary movement of the cartridge 10 to a predetermined amount.

A coil spring 44 presses the cartridge 10 against the locking device 14.

Projections 46, 48 are provided on the locking device 14. Projections 50, 52 are provided on the cap 16.

The cap 16 is axially displaceable together with the cartridge 10 with respect to the locking device 14 and the retaining sleeve 12—towards the right in the drawing—until the projections 46, 48 on the locking device 14 and/or the projections 50, 52 on the cap 16 meet. It should be expressly pointed out that the drawing is not to scale. The distance by which they can be axially displaced is about 1 mm.

The mode of operation of the pen illustrated in the drawing is as follows:

In the operating position shown in the drawing the cap 16 can be easily unscrewed from the cartridge 10 or the writing tip 24 thereof. If the friction between the locking device 14 and the cartridge 10 does not already prevent unwanted rotational entrainment of the cartridge 10 in the unscrewing movement, such rotational entrainment is prevented at the latest by the protrusions 36, 38 coming to bear against the protrusions 40, 42.

The procedure involved in screwing the cap 16 on to the cartridge 10 or the writing tip 24 takes place in an equally problem-free manner.

If the cartridge 10 is to be changed then the cap 16 is displaced axially—towards the right in the drawing—in the condition of being screwed on to the cartridge 10, against the return force of the spring 44, until the projections 46, 48 on the one hand and 50, 52 on the other hand come to bear against each other upon rotary movement about the longitudinal axis of the pen, this corresponding to another operating position of the pen. In this other operating position the cap 16 and the sleeve 12 are then rotated relative to each other about the longitudinal axis of the pen. As the projections 46, 48 come to bear against the projections 50, 52, the locking device 14 is screwed out of the retaining sleeve 12 by the rotational movement of the cap 16 with respect to the retaining sleeve 12. Thereupon the cartridge 10 can be removed and possibly replaced by another cartridge.

The features of the invention disclosed in the foregoing description, the claims and the drawing can be essential both individually and also in any combinations for implementing the invention in the various embodiments thereof.

The invention claimed is:

1. A pen comprising:

a retaining sleeve;

a cartridge positioned at least in part within the retaining sleeve, the cartridge having a tip portion projecting beyond the retaining sleeve;

a locking device receiving at least in part within the retaining sleeve for holding the cartridge in place within the retaining sleeve, the locking device having a first coupling portion;

a cap member selectively positioned on the tip portion of the cartridge, the cap member having a second coupling portion for selectively engaging the first coupling portion on the locking device, wherein the cap member is movable between a first position wherein rotations of the cap removes the cap from the tip portion to a second position wherein the first and second coupling engage so that rotation of the cap removes the locking device from the retaining sleeve so as to allow the cartridge to be removed from the retaining sleeve.

2. A pen according to claim 1 further comprising an elastic return device which biases the cartridge in a direction axially out of the retaining sleeve.

3. A pen according to claim 2 wherein the return device is a coil spring.

4. A pen according to claim 1 wherein the cap is selectively screwed to a portion of the tip portion of the cartridge.

5. A pen according to claim 4 wherein the portion of the locking device received in the retaining sleeve is selectively screwed to the retaining sleeve.

6. A pen according to claim 1 wherein the portion of the locking device received in the retaining sleeve is selectively screwed to the retaining sleeve.

7. A pen according to claim 1, wherein the first coupling portion comprising at least one projection extending axially with respect to a longitudinal axis of the cartridge.

8. A pen according to claim 7, wherein the second coupling portion comprises at least one projection extending axially with respect to the longitudinal axis.

* * * * *